United States Patent [19]

Jezbera

[11] 4,269,118

[45] May 26, 1981

[54] PRINT HAMMER ASSEMBLY METHOD

[75] Inventor: Val K. Jezbera, Thousand Oaks, Calif.

[73] Assignee: Dataproducts Corporation, Woodland Hills, Calif.

[21] Appl. No.: 968,278

[22] Filed: Dec. 11, 1978

[51] Int. Cl.[3] ..... B41J 9/02; H01F 41/02

[52] U.S. Cl. ..... 101/93.34; 29/602 R; 101/93.48

[58] Field of Search ..... 29/602 R, 606, 418; 101/93.48, 93.43, 93.42, 93.29, 93.34, 93.38

[56] References Cited

U.S. PATENT DOCUMENTS

| | | | |
|---|---|---|---|
| 3,643,595 | 2/1972 | Helms et al. | 101/93.34 |
| 3,913,195 | 10/1975 | Beaver | 29/418 X |
| 3,983,806 | 10/1976 | Ishi | 101/93.34 X |
| 4,044,455 | 8/1977 | Watanabe et al. | 29/418 X |

*Primary Examiner*—Carl E. Hall

*Attorney, Agent, or Firm*—Spensley, Horn, Jubas & Lubitz

[57] ABSTRACT

This print hammer assembly method utilizes an elongated thin metal strip punched to form repetitive flag panels each having a flag region non-symmetrically linked to a surrounding frame, and a connector arm extending obliquely between the frame and flag. All assembly steps are performed while maintaining the panels connected in the strip. A flat coil, centered by a boss on the flag region, is sandwiched between and adhesively bonded to the strip and a second flag panel severed from another like strip. Spring wires are attached to the connector arms of both panels before sandwiching, and the coil leads are subsequently attached to the connector arms. Simultaneous soldering of the coil leads and spring wires to the connector arms is carried out from one side of the assembly strip, advantageously using solder paste and focused infrared heating. After discarding the excess frame portions, the hammers are embedded in a molding compound while still linked together in a strip. After molding, the links are severed to separate the individual hammers.

29 Claims, 15 Drawing Figures

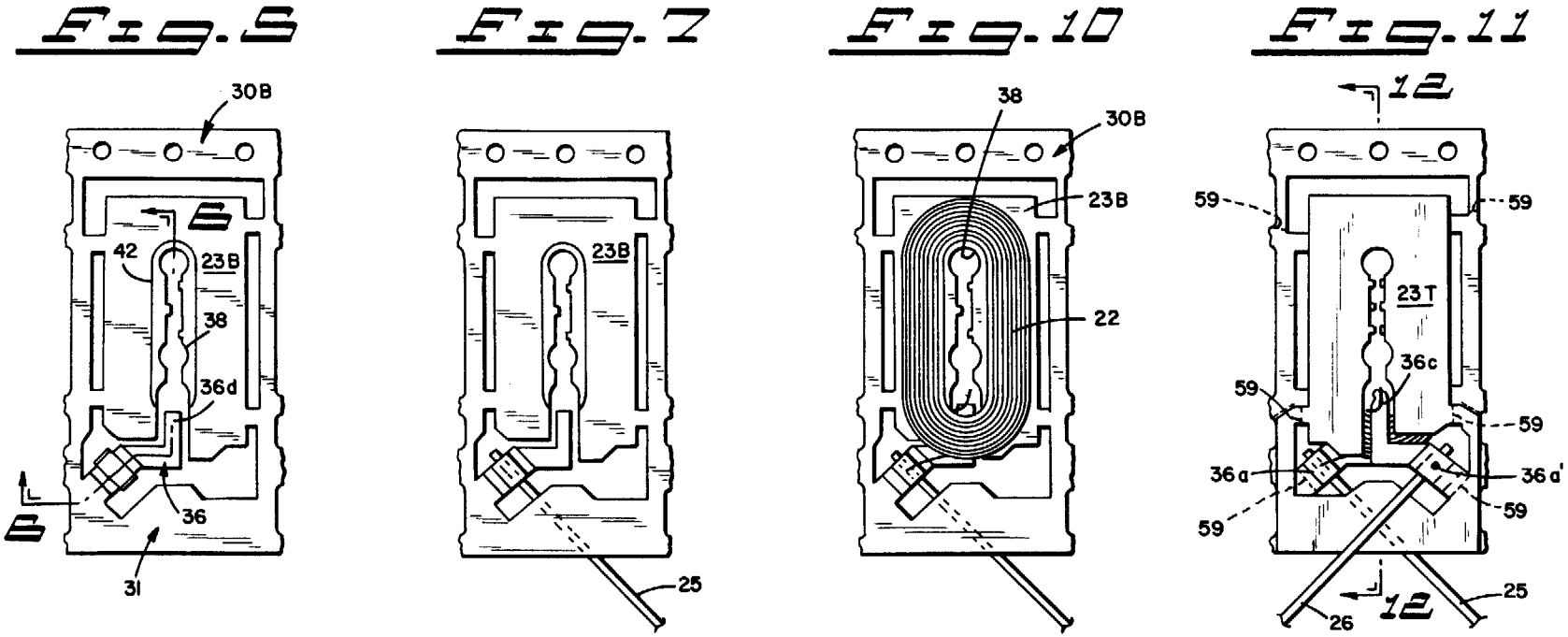
Fig. 11
12
59
23T
36c
36d'
25
26
36a
Fig. 10
30B
23B
22
38
Fig. 7
23B
25
Fig. 5
30B
23B
38
36d
36
42
31
B
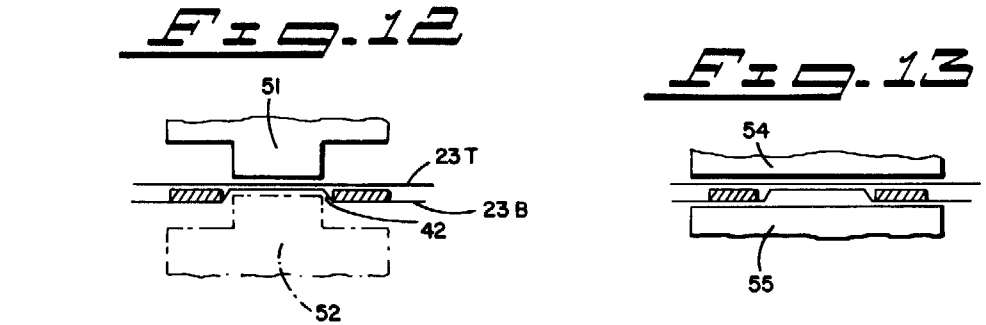
Fig. 13
54
55
Fig. 12
23T
23B
42
51
52
Fig. 6
22
23B
42
36b
36a

PRINT HAMMER ASSEMBLY METHOD

BACKGROUND OF THE INVENTION

1. Field of the Invention

The present invention relates to a print hammer for use in a printing mechanism, and to a method of making the same.

2. Description of the Prior Art

In high speed, moving type, impact printers of the kind typically employed in data processing systems, a separate print hammer is situated at each print position across a row of type. Hammer bank assemblies for this purpose are described in the U.S. Pat. Nos. 3,643,595 to Helms et al and 3,983,806 to Ishi, both assigned to Dataproducts Corporation, the assignee of this case.

Such hammer bank assemblies utilize a plurality of print hammers each having a flat, electrically conductive coil dispose in a generally rigid housing having an impact tip at one end, and supported by a pair of crossed springs at the other end. The springs provide electrical contact to the coil, and aid in restoring the hammer to its rest position subsequent to impact. In the hammer bank assembly, each hammer is situated between a pair of stationarily mounted flat permanent magnets. When a current flows through the coil, the resultant magnetic field interacts with the field of the permanent magnet, resulting in a force which propels the hammer toward the type font and the medium being printed. The basic configuration and operation of such a printing hammer is set forth in the U.S. Pat. No. 3,279,362 to Helms, also assigned to Dataproducts Corporation.

Print hammers and hammer bank assemblies of the type disclosed in the above cited patents have proven to be very effective in use, have exhibited high reliability and long lifetime as measured in number of impact operations between replacement, and have gained widespread acceptance. However, the manufacture of the print hammers themselves is a rather complex process. Typically, it involves the fabrication of ten or twelve fairly complicated individual parts which must be accurately located and assembled in a multi-step process requiring considerable manual labor and expensive fixtures. A principal objective of the present invention is to provide a print hammer having substantially fewer components, and to provide a method of fabrication that is substantially simpler than the prior art.

In a prior art print hammer, a flat coil is sandwiched between a pair of rectangular, rigid, anodized metal plates called "flags". A separate core member was situated in the center of the coil between the flags. A separate terminal board was mounted at one end of the flags. Individual flat wire springs were hooked to terminals on this board. Hard anodizing was used to prevent electrical conduction between the coil, which was electrically connected to the spring wires, and the flags. A complex jig arrangement was necessary accurately to locate the individual flags and associated components while these were joined by appropriate adhesive. Considerable hand labor was necessary to install the individual components in the jig, and to make the requisite mechanical and electrical connections. Once this partial assembly was complete, the individual units were molded to secure in place an impact tip, to embed the terminal board area and its components in a potting compound, and to form a support foot for the flat wire springs.

By contrast, it is an object of the present invention to provide a hammer assembly method in which the unassembled flags, instead of being separate, individual items, are themselves part of an elongated, punched metal strip. The flags are maintained in strip configuration throughout most of the assembly process, thereby facilitating automation of most of the assembly process.

Further objectives of the present invention include the following:

1. the eliminatio n of manual handling of individual hammers;
2. the elimination of components such as the core and terminal board elements of prior art hammers;
3. the elimination of flat wire, formed springs;
4. the elimination of hard anodizing of flags;
5. the replacement of ultrasonic or resistance welding of coil leads by a more controllable joining method;
6. the simplification of production equipment;
7. the elimination of close manufacturing tolerances of certain hammer components;
8. facilitating assembly of a symmetrical hammer from one side only;
9. the reduction of manual finishing operations;
10. reduction of tooling maintenance; and
11. the overall automation of the hammer fabrication process.

SUMMARY OF THE INVENTION

These and other objectives are achieved by a print hammer manufacturing process in which the principal component is an elongated thin metal strip which is punched to form separate flag panels connected by tabs. During substantially the entire manufacturing operation, a plurality of hammers are assembled in this strip format, the hammers being separated as the final manufacturing step. By using this strip approach, the manual handling of individual hammers is virtually completely eliminated.

The pattern which is punched into the flag strip forms a series of separate flag panels which are connected by tabs. Each panel itself includes a flag connected to a surrounding frame by means of links. A spring wire connector arm also is formed in each panel. This connector arm extends obliquely from a corner of the frame and includes crimp ears for attachment of a round spring wire. The connector arm also includes a section which projects into a slot region of the flag, so as to provide a connection point for the inner lead of the hammer coil. Of particular importance is the arrangement of the flag, frame, links and connector arm in each flag panel. The arrangement is such that the same configuration can be used as either the bottom or the top flag for the hammer.

One flag strip is used to form the bottoms of the hammers being assembled. This strip remains substantially intact throughout the assembly process. A second, like strip is used to form the tops of the hammers. At an appropriate step in the process, individual flags are severed from this strip and attached to the hammers being assembled on the bottom flag strip.

In the process, the inner surfaces of both top and bottom flag strips may be coated with a thermoplastic adhesive. The flags of the bottom strip are embossed to form a central, coil-locating region. Straight spring wires of round cross-section are attached to the connector arms of both the upper and lower flag strips. The wires are held in place by crimping. A flat coil is placed on the bottom flag, located by the boss. The top flag, severed from the second flag strip, is placed face down atop the coil so that the connector arms of the bottom and top flags are situated on opposite sides of a centerline through the hammer being formed. Localized heating is used to bond together the bottom and top flags in the boss region, by means of the pre-coated adhesive.

With the assembly so held together, the inner lead wire of the coil is connected to the end portion of the connector arm of one flag, and the outer coil lead is attached to the connector arm of the other flag at the point of spring wire attachment to the bottom flag. The entire hammer assembly is heated between plates to adhesively tack the coil to the flags. A soldering compound is applied to both connector arms at the point of spring wire attachment, and to the connector arm end to which the inner coil lead is attached. Focused infrared heating, or other heating technique is used from the top side only of the assembly to solder all three coil lead and spring wire connection points. The electrical insulation of both coil leads is penetrated by the thermochemical action of the soldering compound and by the high energy concentration of the localized heating.

Next, excess portions of the frames surrounding both the bottom and top flags are severed and discarded, leaving the partially assembled hammers connected to one another by the link and tab members of the original flag strip. While still so connected, a group of the hammers simultaneously are embedded in a molding compound such as a structural epoxy. A hammer tip also may be mounted in this embedding process. A single multicavity mold may be used simultaneously to form a plurality of hammers. For ach hammer, the hammer housing and the separate spring-wire foot assembly are formed simultaneously. Finally, the connecting links are cut away to separate the hammers and complete the assembly process.

BRIEF DESCRIPTION OF THE DRAWINGS

The detailed description of the invention will be made with reference to the accompanying drawings, wherein like numerals designate corresponding parts in the several figures.

FIG. 5 through 15 illustrate successive steps in the hammer assembly process and are individually identified in the flow chart of FIG. 2.

DESCRIPTION OF THE PREFERRED EMBODIMENT

The following detailed description is of the best presently contemplated mode of carrying out the invention. Ths description is not to be taken in a limiting sense but is made merely for the purpose of illustrating the general principles of the invention since the scope of the invention best is defind by the appended claims.

Figure 1:
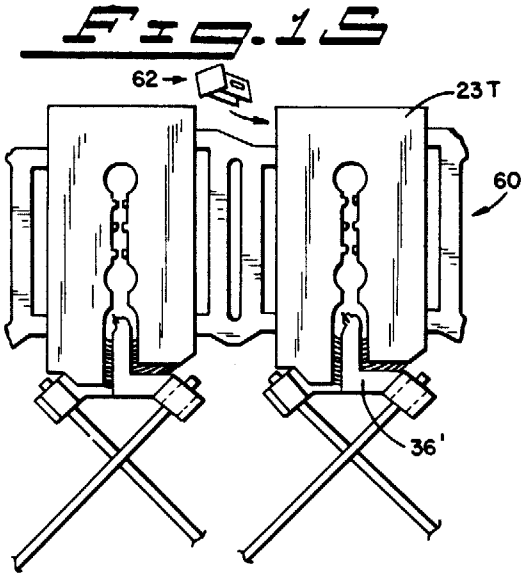
FIG. 1 is a perspective view of a print hammer manufactured in accordance with the present invention.

A typical print hammer 20 manufactured in accordance with the present invention is shown FIG. 1. The hammer 20 consists of a coil housing 21 containing a flat coil 22 (FIG. 4) sandwiched between a pair of flags 23B, 23T (described below) and embedded in a molding compound such as a structural epoxy. The main portion of the coil housing 21 may have a typical thickness on the order of 0.035 inches. The impact end **21*a* has an enlarged thickness, typically on the order of 0.10 inches, and includes a forwardly projecting impact tip 24**.

Projecting diagonally in opposite directions from an enlarged bottom end **21*b* of the housing 21, are a pair of spring wires 25, 26 each having a round cross-section. The spring wires 25, 26 are laterally separated from one another so that they do not touch at the apparent crossover location shown at 27 in FIG. 1. The spring wires 25, 26 pass through, and are embedded in a foot member 28 formed of the same molding compound as the coil housing 21. The spring wire lower ends 25*a*, 26*a* project below the foot member 28 and are available for electrical connection to the hammer 20**.

Figure 3:
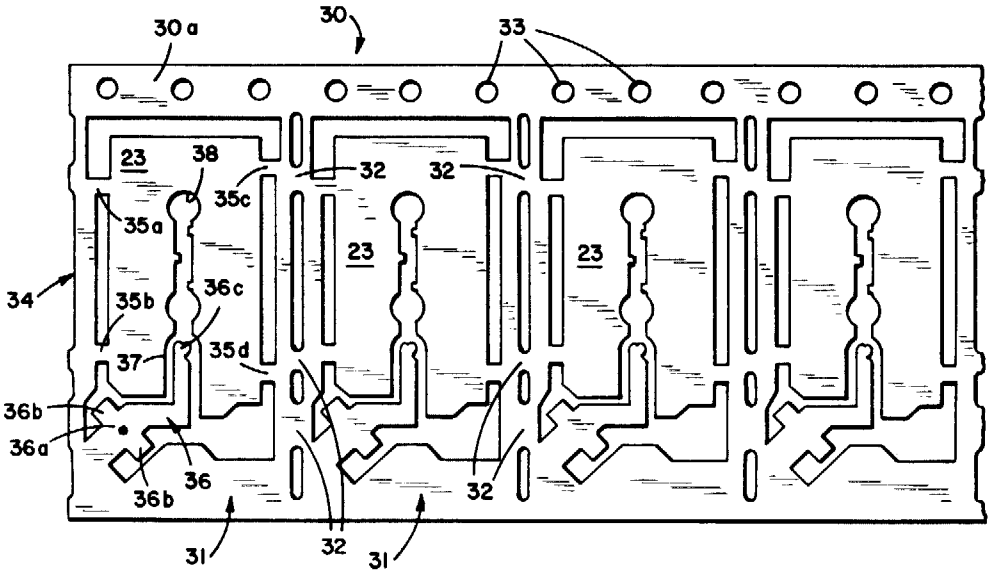
FIG. 3 is a top plan view of a flag strip from which hammers like that of FIG. 1 are assembled.
Figure 1:
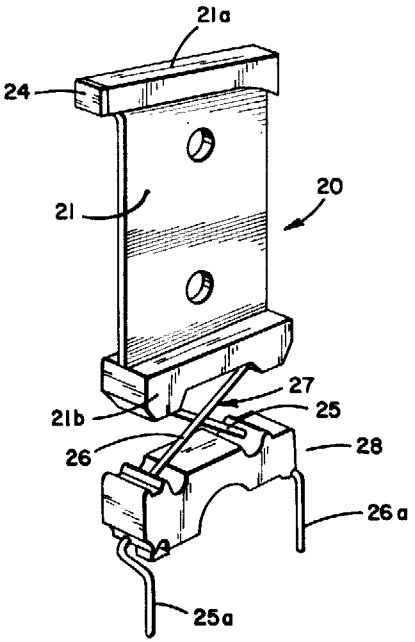

A principal component utilized in the mass production of print hammers 20 is a "flag strip" 30 (FIG. 3) consisting of an elongated thin metal strip that is punched to form a plurality of separate flag panels 31 connected by tabs 32. By way of example, the flag strip 30 may be formed of aluminum having a thickness of 0.004 inches and a width of 3 inches. The strip 30 is of arbitrary length. In a preferred embodiment, two identical flag strips 30 are used to provide respectively the bottom and top flags 23B, 23T.

Initially, a set of index holes 33 may be punched at regular intervals along a longitudinal border region **30*a* of the strip 30. These index holes 33 then may be used both to locate and to transfer the strip 30** during subsequent assembly steps.

The first of these steps is the successive punching of the strip 30 to form the individual flag panels 31. In the preferred design illustrated in FIG. 3, each panel 31 includes a flag 23 which is connected to a surrounding frame 34 by a set of links **35*a*–35*d* (collectively referred to as links 35). Extending from a corner of the frame 34 is a spring wire connector arm 36 having a diagonal spring wire-receiving section 36*a* from which project laterally a pair of crimp ears 36*b* . The free end of the connector arm 36 forms a wire terminal 36*c*. This terminal end 36*c* is situated within a slot 37 which leads to a central opening 38 in the flag 23. Each of the panels 31** is of identical shape.

Figure 2:
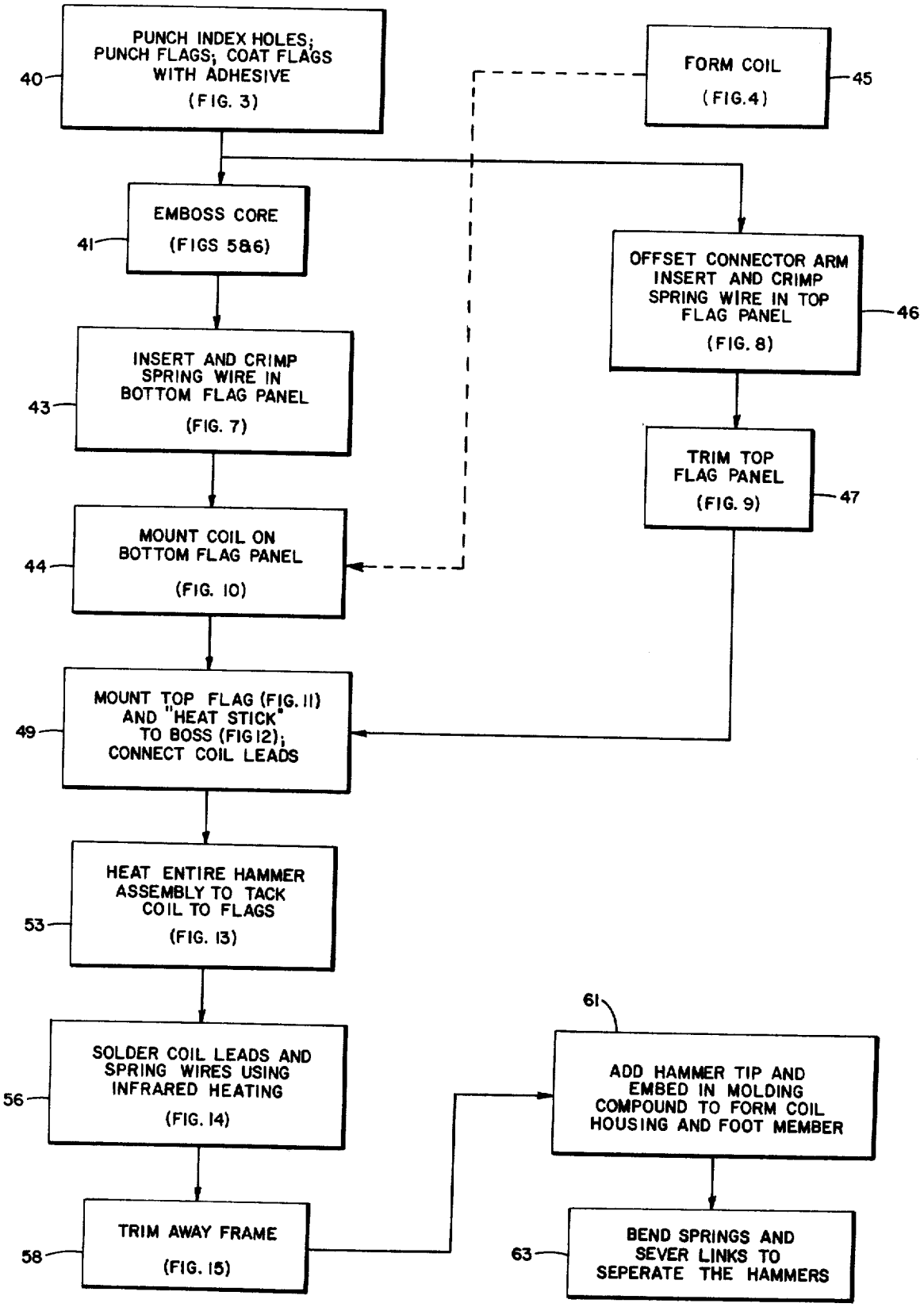
FIG. 2 is a flow chart of the assembly steps in the inventive print hammer manufacturing process.

As part of the initial fabrication procedure (step 40, FIG. 2) one face of each flag 23 is coated with a thermoplastic adhesive. This adhesive coating may be done either before or after the flag panels 31 are punched. The steps of index hole perforation, flag panel punching and epoxy coating may be carried out in automated fashion on a strip 30 which is wound from reel to reel during the operation.

As a next assembly step 41, a coil centering boss 42 is formed in each panel 31 of a first flag strip 30B that is used to provide the bottom flags 23B (FIGS. 5 and 7). This flag strip 30B is maintained intact as a continuous strip throughout most of the assembly process.

Figure 4:
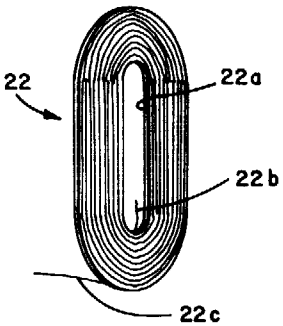
FIG. 4 is a perspective view of a flat coil utilized in each print hammer.

As illustrated in FIGS. 5 and 6, the coil centering boss 42 surrounds the central flag opening 38, and conforms in shape to the central opening **22*a* of the coil 22 (FIG. 4). Advantageously, the height of the boss 42 corresponds to the thickness of the coil 22. The same embossing operation that is used to form the coil centering boss 42 also may be used to offset or depress the spring wire-receiving section 36*a* of the connector arm 36 (FIGS. 5 and 6). Also, the terminal end 36*c* of the connector arm 36 may be severed so as to leave a short stub 36*d* at the end of the arm 36. Also, the crimp ears 36*b* may be folded upward to facilitate insertion of the spring wire 25**.

Next, (step 43, FIG. 7) a straight spring wire 25 is placed through the upstanding ears 36b of the connector arm 36. The ears 36b then may be folded over and crimped to hold the spring wire 25 in place. Advantageously, the spring wire 25 itself may have a circular cross-section, with a typical diameter on the order of 0.029 inches.

Next, a coil 22 is placed onto the bottom flag 23B (step 44,FIG. 10) and centered with respect to the boss 42. The coil itself may be wound (step 45) of 5.5 mil diameter aluminum wire arranged in four and five layers so as to form a flat coil having the overall shape shown in FIG. 4. Advantageously, the coil wire may be insulated and have an overcoat of a thermoplastic adhesive, typically the same type of adhesive which is used to coat the faces of the flags 23.

Figure 9:
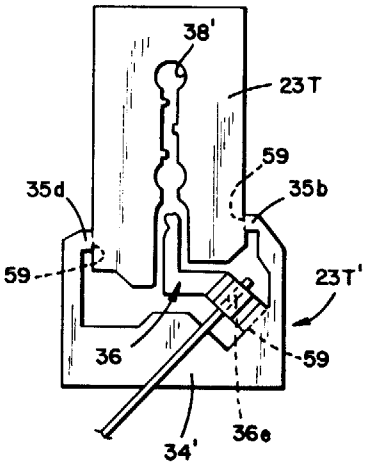

As separate operations which may be carried out concurrently with the process steps 41 through 45, a second flag strip 30T is processed (FIGS. 8 and 9) to form the top flags 23T. First (step 46) a flag strip 30 (FIG. 3) is turned "upside down", so that when viewed from the aspect of FIG. 8 the connector arm 36 appears to project from the lower right hand corner of the frame 34 rather than the lower left hand corner of the bottom strip 30B. The spring wire receiving section 36a' is offset upwardly viewed in FIG. 8) to provide a seat for the spring wire 26. This wire 26 is situated "above" the frame 34, and is crimped in place by the ears 36b' which are folded back "under" the offset region 36a'.

Figure 8:
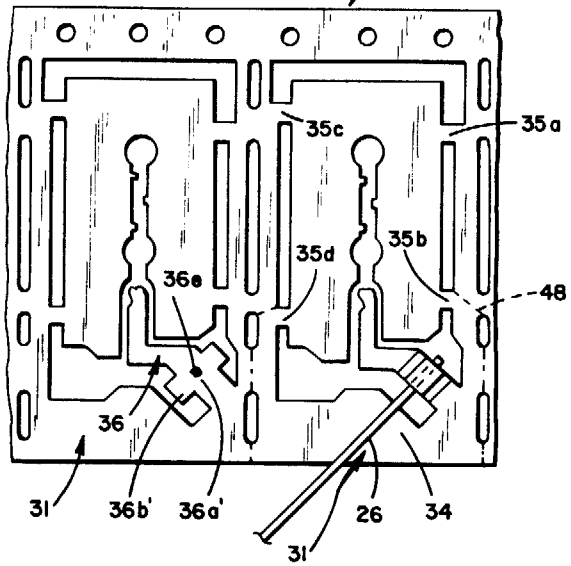

As a next step 47, individual top flag panels 23T' (FIG. 9) are formed by severing the flag panels 31 of the top strip 30T along the broken line 48 shown in FIG. 8. The upper two links 35a ,35c are severed, while the lower links 35b and 35d are left in place. These keep the lower frame portion 34' and the connector arm 36 attached to the top flag 23T'.

The severed top flag panel 23T' so formed (FIG.9) next is mounted (step 49 and FIG. 11) atop the coil 22 that is mounted on the bottom flag strip 30B. Alignment can readily be accomplished by matching the central opening 38' in the top flag 23T with the corresponding opening 38 in the boss 42 region of the bottom flag 23B.

The top flag 23T immediately is bonded in place by bringing a heating element 51 into contact with the portion of the top flag 23T that is aligned with the boss 42. This is illustrated in FIG. 12. Optionally, a mating heating element 52 may be disposed beneath the lower flag 23B within the boss 42 region. With this arrangement, the boss region is heated to a temperature at which the adhesive on the mating faces of the flags 23B and 23T is brought to a plastic or tacky state. Typically this may take about two seconds. The heating elements 51, 52 then are withdrawn. The adhesive quickly cools and solidifies, thereby effectively bonding together the top and bottom flags 23B and 23T in the region of the boss 42. The resultant bond is sufficient to maintain the top flag 23T in place during the next assembly operations. A permanent mechanical bond between the hammer components is not required at this step.

Next, the electrical leads 22b , 22c (FIG. 4) of the coil 22 are mechanically attached to the connector arm terminal 36c of the top flag 23T and to the spring wire receiving region 36a of the bottom flag 23B.

Next, (step 53 and FIG. 13), the entire hammer assembly is sandwiched between two hot plates 54, 55. This heating makes the adhesive on the inner faces of both the bottom and top flags 23B, 23T and on the coil 22 become tacky. When the heating plates 54, 55 then are removed, the adhesive solidifies so as to bond firmly the sandwich consisting of the bottom flag 23B, the coil 22 and the top flag 23T.

Figure 14:
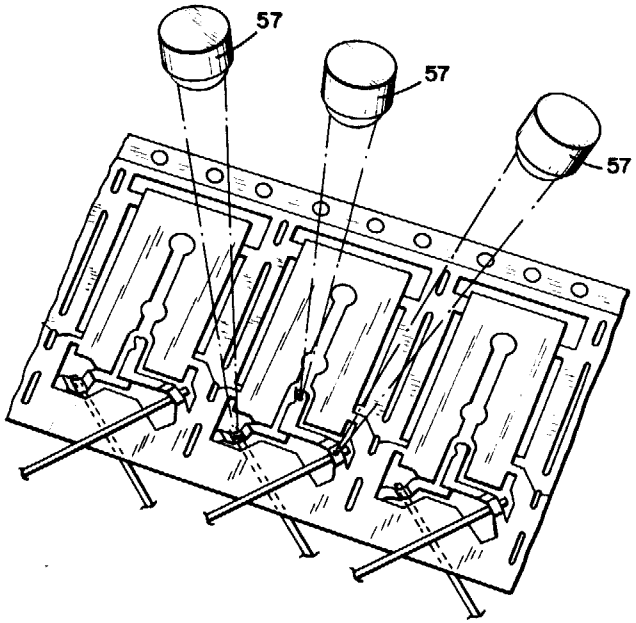

The next step 56 is to solder the two spring wire connector regions 36a , 36a' and the terminal 36c from the same side of the hammer assembly. This is illustrated in FIGS. 11 and 14. First, a measured amount of solder paste is deposited on each of the regions 36a, 36a ' and 36c . The paste may include appropriate flux and solder. Then, three infrared radiation sources 57 (mounted on an appropriate jig, not shown) are focused respectively on the three areas 36a, 36a ' and 36c. The wavelength, amount of radiated energy, and time parameters are appropriately adjusted so that the incident, focused infrared radiation will melt the solder, cause the sodlder to penetrate the coil wire isulation, and accomplish the requisite soldering operation. These parameters may be different for the three regions. For example, a shorter time period, or a lower energy level may be sufficient to solder the inner coil lead 22b to the terminal 36c than is required to solder both the spring wire 25 and the outer coil lead 22c to the connector arm region 36a. Soldering of the spring wire 26 to the connector arm region 36a' may be aided by the presence of a small opening 36e (FIGS. 3, 8and 9) which is formed in the flag strip 30 during the initial punching operation (step 40).

Now (step 58 and FIG. 15) the lower frame portions 34 of both the bottom and top flags 23B and 23T are severed from the assembly by cutting where indicated by the broken line 59 in FIG. 11. This results in a strip 60 (FIG. 15) of partially completed hammers that are still connected by the links 35a–35d and tabs 32 of the bottom frame 30B. The top flag 23T and the connector arm 36' are attached to the structure 60 solely by the adhesive which bonds them to the boss 42 and the coil 22. The top connector arm 36' is totally separated from the top flag 23T. Thus there is no electrical connection between the connector arm 36' and the top flag 23T. Electrical isolation of the inner coil lead 22b from the flag 23T thus is achieved. Similarly, beneath the coil 22 the lower connector arm 36, to which the outer coil lead 22c is attached, is both physically and electrically isolated from the bottom flag 23B.

Next, a group of the attached incomplete hammer assemblies 60 are simultaneously molded to form the coil housing 21 and the foot member 28 (step 61). This may be accomplished by separating the assembly 60 into strips each of which contains say a dozen of the connected hammer assemblies. Each such strip then may be placed in a multiple cavity mold appropriately configured to form both the coil housings 21 and the foot members 28 for all dozen of the hammers in the strip.

A generally U-shaped metal hammer tip 62 (FIG. 15) may be appropriately positioned in the mold, or alternatively, may be clipped to the upper corner of the sandwiched flags 23B, 23T to provide a rigid font-striking surface at the impact tip 24 of the hammer 20.

An appropriate molding compound, such as a structural epoxy, then is used to embed the assembly 60, thereby to form the coil housing 21 and the foot member 28. When the embedding operation is complete, the assembly 60 is removed from the mold and the links 35 are severed to separate the now completed hammers 20.

After the molding step 61, the spring wires 25, 26 may be bent so that they project downwardly in parallel fashion from the foot member 28, as shown in FIG. 1. The portions of the spring wires 25, 26 which are embedded in the foot member 28 may be coated with an elastomer. Alternatively, part of the foot itself may be coated with an elastomer. Such elastomer may have the benefit of damping ultrasonic vibrations of the foot during hammer operatin when the hammers are installed in an appropriate hammer operation when the hammers are installed in an appropriate hammer bank assembly.

The spring wires 25, 26, may be of any appropriate material such as berrylium copper or steel. Alternatively, the spring wires 25, 26 could even be formed of a conductive plastic, or of a plastic that was coated or iserted with metal so as to provide electrical conduction to the coil 22.

Since each flat 23B and 23T is substantially U-shaped, induced eddy currents are substantially reduced or eliminated. The slots 37 leading to the central openings 36 yield this result, by eliminating a current path around each opening 36.

From the foregoing description, it will be appreciated that one of the features of the flag strip 30 which makes the present invention workable is the offset arrangement of the links 35. This offset arrangement permits (step 58 and FIGS. 11 and 15) the lower links **35*b*, 35*d* of the top flag 23T to be severed, while still maintaining the integrity of the links 35 that connect adjacent flag panels in the bottom strip 30B. Thus, the staggered link arrangement permits the entire mass production hammer assembly operation to be carried out atop one flag strip 30B** which maintains its integrity as a continuous strip throughout the entire fabrication process.

I claim:

1. A method for making a hammer for a printer, comprising:

punching an elongated thin metal strip to form separate flag panels connected by tabs, each panel including a spring wire connector arm, inserting spring wires into the connector arm of a first flag panel in said strip and into the connector arm of a separate second flag panel, sandwiching a flat coil between said first flag panel and said second flag panel while maintaining said first flag panel connected in said strip, connecting the leads of said coil to the respective connector arms of said first and second flag panels, and embedding said sandwiched flag panels and coil in a molding compound.

2. A method according to claim 1 wherein said first and second flag panels are substantially identical, the portion of the connector arm to which said spring wire is attached being on one side of a centerline of said flag panel, said sandwiching comprising:

placing said first flag panel face up against one side of said coil and placing said second flag panel face down against the other side of said coil, so that the spring wire attachment portions of the connector arms of said first and second flag panels are situated on opposite sides of a centerline of said coil.

3. A method according to claim 2 wherein said punching also forms in said strip a frame surrounding a flag section and attached thereto by links, each flag panel comprising a flag section and its surrounding frame, and including the step of severing said second flat panel from the strip in which it is formed and discarding a portion of the frame of said second flag panel before placing said second flag panel against the other side of said coil.

4. A method according to claim 2 or 3 wherein said punching includes forming in each flag panel a central opening and a slot leading thereto, an end of the connector arm of at least one flag panel extending through said slot into said central opening, said sandwiching including aligning said coil with said central openings of said first and second flag panels, and wherein said connecting includes attaching one lead of said coil to said one connector arm end which extends into said central opening, and attaching the other lead of said coil to the other connecting arm.

5. A method according to claim 3 including, subsequent to said connecting:

severing and discarding frame portions of both said first and second flags so that adjacent sandwiched flag panels and coils of said strip are attached only via said links and said tabs, and wherein said enbedding is carried out with said adjacent sandwiched flag panels and coils so attached.

6. A method according to claim 1 comprising:

coating, prior to said sandwiching, a portion of at least one of said first or second flag panels with a heat sensitive adhesive, forming a raised coil-locating region in at least one of said first or second flag panels, said sandwiching including centering said coil on said raised region, and heating, subsequent to said sandwiching, at least the raised region of one flag panel and the adjacent region of the other flag panel to secure together said first and second flag panels by means of said adhesive.

7. A method for making hammers for a printer, comprising:

forming first and second thin strips having repetitive, connected, generally planar panels, each panel having a frame at least partially surrounding a flag region and connected thereto by links, said flag region having a slot extending to one edge thereof, each panel also having an electrically conductive connector arm extending from said frame into said slot, attaching spring wires to the connector arm of a first panel in said first strip and to the connector arm of a second panel in said second strip, sandwiching an electrical coil between said first panel and second panels while maintaining said first panel attached in said first strip, and connecting the electrical leads of said coil to the connector arms of said first and second panels, at least one of said leads being connected to the portion of a connector arm which extends into said slot.

8. A method according to claim 7 wherein:

said flag region is formed with a central opening to which said slot extends; wherein each connector arm is formed to extend obliquely from adjacent a corner of said frame and to include a wire connection terminal at the distal end thereof, said terminal being situated within said central opening; wherein said sandwiching includes centering said coil in alignment with said central opening; and wherein said connecting includes attaching the inner coil lead to the terminal situated within said flag region central opening.

9. A method according to claim 8 wherein sandwiching includes placing said coil atop said first panel and placing said second panel face down atop said coil, so that the connector arms of said first and second panels are situated on opposite sides of a centerline of the hammer being made.

10. A method according to claim 9 further comprising simultaneously soldering one spring wire and one coil lead to the connector arm of one flag panel and the other spring wire and other coil lead to the connector arm of the other flag panel, said simultaneous soldering being carried out from one side only of the hammer being made.

11. A method according to claim 7 wherein each connector arm is situated obliquely on one side of a centerline of the hammer being made, wherein said second panel is separated from said second strip prior to said sandwiching, wherein said sandwiching includes placing said coil atop said first panel and placing said separated second panel face down atop said coil, so that the connector arms are situated on opposite sides of said centerline, and wherein said sandwiching further includes adhesively bonding together the sandwiched components.

12. A method according to claim 11 wherein said panels are formed so that the links connecting one side of each flag region to the frame are offset with respect to the links connecting the other side of that flag region to said frame, and including, subsequent to said bonding, the step of severing the portions of the frames of said first and second panels from which said connector arms extend while maintaining said first panel attached in said first strip by means of said links, said offset links facilitating such severing, the flag region and connector arm of said second panel being thereafter held to the other components of said hammer being made by said adhesive bonding.

13. A method according to claim 12 further comprising embedding said sandwiched components and a portion of said spring wires in a molding compound while maintaining said first panel attached in said first strip.

14. A method according to claim 13 wherein a plurality of like hammers are made on adjacent panels of said first strip, and wherein said embedding is carried out in a multichambered mold to facilitate simultaneous embedding of said plurality of like hammers.

15. A print hammer made by the process of claim 7.

16. A method for the mechanized mass production of unitary print hammers of the type having an electrical coil sandwiched between first and second planar flag panels, comprising:

forming a first elongated thin metal strip having a plurality of connected first flag panels, sequentially attaching and securing other hammer components to said connected first flag panels and performing requisite hammer assembly steps from one side only while maintaining said plurality of first flag panels connected in said strip, and separating each of the first flag panels and associated attached components from said first strip and one another to provide a plurality of individual units.

17. A method according to claim 16 wherein said forming includes providing a set of index holes along said strip, said steps of sequentially attaching and performing all utilizing said index holes to transport and locate said first flag panels for attachment and assembly.

18. A method according to claim 16 further comprising:

forming a second elongated strip substantially identical to said first strip, said second flag panels comprising panels separated from said second strip.

19. A method according to claim 18 wherein portions of each substantially identical panel in said first and second strips are non-symmetric about a centerline through said panel, said attaching including mounting a separated second flag panel atop said first strip in facing relationship to a corresponding first flag panel, and performing said subsequent assembly steps from one side of said first strip, said non-symmetrical panel configuration facilitating such one-sided assembly performance.

20. A method according to claim 19 wherein said connected flag panels include a surrounding frame and a planar connector arm extending obliquely from said frame, and including the steps of:

attaching a first spring wire to the connector arm of each first flag panel in said first strip and attaching a second spring wire to the connector arm of each second flag panel from said second strip, said spring wires extending obliquely from said respective arms, so that when said second flag panel is mounted, said second spring wire will cross but not touch said first spring wire, and embedding the assembled sandwiched coil and panels of each hammer in a molding compound while simultaneously forming a foot member of said molding compound, a portion of both said first and second spring wires, on the opposite side of said cross from said flag panels, being embedded in said foot member, said embedding being carried out prior to separation of said completed hammers from said strip.

21. A method according to claim 19 comprising:

forming a raised central boss on each first flag panel, placing a flat coil having a central opening into each first flag panel with said central opening surrounding and positioned by said boss, said separated second flag panel being mounted atop said boss and emplaced coil, and adhesively bonding the sandwich of said first flag panel, said coil and said mounted second flag panel.

22. A method according to claim 21 further comprising:

attaching the leads of said coil to the respective connector arms of said first and second flag panels, and simultaneously soldering, from one side of said first strip, both said leads and said spring wires to both said connector arms.

23. A method according to claim 22 wherein said soldering is accomplished by utilizing focused infrared heat.

24. A method according to claim 7 including the step of separating an individual flag and connector arm and a portion of said frame from said second strip prior to said sandwiching step, said separated flag and connector arm being connected to said frame portion thereby maintaining correct orientation of the separated flag and connector arm during the sandwiching step.

25. A print hammer assembly fabricated from a flag strip, said flag strip comprising an elongated, unitary, planar thin strip of metal having a plurality of identical flag panels formed therein, each flag panel including:

a generally rectangular flag region, a frame substantially surrounding said flag region, a plurality of links connecting said frame to said flag region, and a connector arm extending from said frame at one side of a centerline through said flag region, wherein said connector arm includes a spring wire connection region, and wherein each flag panel includes an opening between said frame and said flag panel situated symmetrically opposite the spring wire connection region on the opposite side of said centerline from said connector arm, so that when one of said panels is separated from said strip and superimposed atop and in facing relationship with another panel of said strip, the spring wire connection region of the connector arm of said other strip will be exposed through the symmetrically situated opening of said one panel, the print hammer assembly comprising:

a flat electrical coil sandwiched between said one and said other facing flag panels, the electrical leads of said coil being attached to said connector arms, a pair of spring wires attached respectively to the connection regions of the connector arms of said one and other facing panels, and said spring wires and said electrical leads being solder-connected to said connector arms, said solder connections all being accessible from one side of said sandwiched assembly.

26. A method according to claim 20 further comprising: providing an elastomer for the portion of said spring wires within said foot member.

27. A method according to claim 22 wherein said soldering utilizes a soldering paste and wherein said heating causes the soldering paste to penetrate the electrical insulation of said leads.

28. A method for making a hammer for a printer comprising:

forming an elongated thin metal strip of separate but connected flag panels, each panel including a spring wire connector arm;

inserting spring wires into the connector arm of a first flag panel in said strip and into the connector arm of a separate second flag panel;

sandwiching a flat coil between said first flag panel and said second flag panel while maintaining said first flag panel connected in said strip; and connecting the leads of said coil to the respective connector arms of said first and second flag panels.

29. The method of claim 29 further comprising the step of encasing said sandwiched flag panels and coil within a housing.

* * * * *